US009914276B2

(12) United States Patent
Blay Orenga et al.

(10) Patent No.: US 9,914,276 B2
(45) Date of Patent: Mar. 13, 2018

(54) MACHINE AND METHOD FOR ASSEMBLING BOXES

(71) Applicant: OBEIKAN MDF ESPANA, S.L., Canet d'en Berenguer (Valencia) (ES)

(72) Inventors: Manuel Blay Orenga, Canet d'en Berenguer (ES); Javier Ramon Garcia Aranda, Canet d'en Berenguer (ES); Jose Munoz Gomez, Canet d'en Berenguer (ES); Salvador Martinez Colorado, Canet d'en Berenguer (ES)

(73) Assignee: OBEIKAN MDF ESPANA, S.L., Canet d'en Berenguer (Valencia) (ES)

( * ) Notice: Subject to any disclaimer, the term of this patent is extended or adjusted under 35 U.S.C. 154(b) by 411 days.

(21) Appl. No.: 14/412,230

(22) PCT Filed: May 21, 2013

(86) PCT No.: PCT/ES2013/070321
§ 371 (c)(1),
(2) Date: Dec. 31, 2014

(87) PCT Pub. No.: WO2014/013107
PCT Pub. Date: Jan. 23, 2014

(65) Prior Publication Data

US 2015/0183177 A1 Jul. 2, 2015

(30) Foreign Application Priority Data

Jul. 19, 2012 (ES) ..... 201231141

(51) Int. Cl.
*B31B 1/60* (2006.01)
*B31B 17/74* (2006.01)
(Continued)

(52) U.S. Cl.
CPC ..... *B31B 17/74* (2013.01); *B27M 3/36* (2013.01); *B65D 9/34* (2013.01); *B31B 50/06* (2017.08);
(Continued)

(58) Field of Classification Search
CPC ..... B31B 17/74; B31B 2201/0264; B31B 2217/066; B31B 2217/08;
(Continued)

(56) References Cited

U.S. PATENT DOCUMENTS 3,410,441 A * 11/1968 Rhyne ..... A47B 88/941 220/4.28
3,640,189 A 2/1972 Bowman
(Continued)

FOREIGN PATENT DOCUMENTS

ES 1 073 141 10/2010
GB 2 189 184 10/1987

OTHER PUBLICATIONS

International Search Report dated Nov. 27, 2013 in International (PCT) Application No. PCT/ES2013/070321.

*Primary Examiner* — Sameh Tawfik
(74) *Attorney, Agent, or Firm* — Wenderoth, Lind & Ponack, L.L.P.

(57) ABSTRACT

A machine for assembling boxes comprising five independent parts including two head walls, two side walls and a base with peripheral flanges that engage with grooves in a lower portion of the side walls and the head walls. Ends of the head walls have end tongues that are inserted into notches adjacent to ends of the side walls. The machine includes a central assembly station comprising a base ring inside which a stationary forming die is disposed. A base of a box to be formed is positioned on a lower face of the stationary forming die such that while the base of the box is
(Continued)

held in position, horizontal push devices are activated which move the head walls and the side walls towards the base of the box which is locked in position against the lower face of the stationary forming die.

14 Claims, 7 Drawing Sheets

(51) Int. Cl.

| | |
|---|---|
| ***B27M 3/36*** | (2006.01) |
| ***B65D 6/34*** | (2006.01) |
| *B31B 50/06* | (2017.01) |
| *B31B 50/81* | (2017.01) |
| *B31B 105/00* | (2017.01) |
| *B31B 110/35* | (2017.01) |
| *B31B 120/00* | (2017.01) |

(52) U.S. Cl.
CPC ..... *B31B 50/81* (2017.08); *B31B 2105/00* (2017.08); *B31B 2105/002* (2017.08); *B31B 2110/35* (2017.08); *B31B 2120/502* (2017.08)

(58) Field of Classification Search
CPC .... B31B 2217/106; B65D 2519/00064; B65D 9/34; B27M 3/36
See application file for complete search history.

(56) References Cited

U.S. PATENT DOCUMENTS

| | | | | |
|---|---|---|---|---|
| 3,913,300 | A * | 10/1975 | Benzing | B65B 7/2807 493/169 |
| 4,028,999 | A * | 6/1977 | Lee | B31B 1/00 493/126 |
| 4,283,188 | A | 8/1981 | Wingerter et al. | |
| 4,720,020 | A * | 1/1988 | Su | B65D 19/42 220/1.5 |
| 5,161,709 | A * | 11/1992 | Oestreich, Jr. | B65D 19/12 220/1.5 |
| 5,597,084 | A * | 1/1997 | Parasin | B65D 11/1873 206/600 |
| 5,807,223 | A * | 9/1998 | Holton | B31D 1/005 493/120 |
| 6,309,335 | B1 * | 10/2001 | Holton | B31B 1/00 493/122 |
| 6,312,369 | B1 * | 11/2001 | Plemons | B65D 11/1893 493/136 |
| 8,109,402 | B2 * | 2/2012 | Hartwall | B65D 19/18 206/600 |
| 8,696,535 | B2 * | 4/2014 | Vizanova Alzamora | B31B 3/00 493/126 |
| 9,027,897 | B2 * | 5/2015 | Hill | F16M 13/00 248/346.01 |
| 2007/0095825 | A1 * | 5/2007 | Tsao | B65D 11/1826 220/6 |
| 2013/0146606 | A1 | 6/2013 | Blay Orenga et al. | |

* cited by examiner

MACHINE AND METHOD FOR ASSEMBLING BOXES

BACKGROUND OF THE INVENTION

1. Field of the Invention

The present invention, as expressed in the wording of this specification, relates to a machine and method for assembling boxes, such that, by means of the machine of the invention, boxes which comprise a base and four lateral walls: two head walls and two side walls are assembled, with the particularity that all the parts are independent elements made of a rigid material.

The assembly of the box is carried out by first engaging two opposite lateral walls, moving the same in perpendicular planes with respect to the base, which is held in a static position during the coupling of these first two lateral walls, to then proceeding with the engagement of the other pair of opposite lateral walls, which shall also move in perpendicular planes with respect to the plane of the base, still held in a static position.

2. Description of Related Art

A type of box to be assembled corresponds to the utility model with application number U 201030859, such that the couplings of the lateral walls (side walls and head walls) are carried out as described in the preceding paragraph.

Thus, the objective of the invention is a machine that is simple to operate but is highly precise in the coupling of the different independent parts that make up the box, also comprising a simple assembly method. The foregoing translates into a high performance in the assembly of the boxes.

The main problem in the automation of the assembly of the type of boxes of the invention is the high degree of precision with which the parts must be moved in order to engage with each other correctly.

Nowadays machines for assembling boxes which have a structure that separately supports, in principle, the different parts to then bring them to an assembly station where the assembly of the box is carried out by means of different mechanisms and devices, are known.

In some cases, these machines exhibit a significant degree of complexity, while the lack of precision brings about a bad operation and a defective assembly of the boxes, which requires stopping the machine until the abnormality that is produced is corrected.

The utility model with application number U 201030859 consists of a box comprising a base and four lateral walls: two head walls and two side walls, all of these parts being independent elements, such that the base is provided with peripheral flanges that engage with grooves provided in the lower portion of the side walls and head walls, the head walls also being provided with end tongues that are inserted into notches provided close to the ends of the side walls.

SUMMARY OF THE INVENTION

With the purpose of achieving the objectives and avoiding the inconveniences referred to in previous sections, the invention proposes a machine for assembling boxes, these boxes being of the type that comprise four independent parts, namely: two side walls, two head walls and a base provided with peripheral flanges that engage with grooves provided in the lower portion of the side walls and head walls, the head walls being provided with end tongues that are inserted into notches provided close to the ends of the side walls.

The machine includes a characteristic central assembly station of the boxes, which comprises:

- A base ring inside which a stationary forming die is arranged, the base of the box to be formed being positioned on its lower face by means of a lifting device with vertical mobility in both directions, which moves the base upwards from a lower position to an upper position against said stationary forming die in a first performance, the peripheral flanges protruding from the base with respect to the perimeter of the stationary forming die.
- Four vertical columns corresponding to the four vertical corners of the box.
- Four inclined feeders of the side walls and head walls arranged in vertical planes, each feeder comprising pairs of inclined guiding profiles attached by their lower ends converging towards to the vertical columns.
- Vertical plates closing the spaces delimited between pairs of vertical columns, with the exception of lower windows through which the side walls and head walls pass during their horizontal movement to engage with the peripheral flanges of the base at the end of the assembly of the box, where the side walls and head walls enter into contact with the peripheral edges of the stationary forming die.
- A cylinder located inside the space delimited by the vertical columns above the stationary forming die, a vertically movable head that can move in both directions is connected to the piston rod of said cylinder, to which downward push skids under the first side walls and head walls, arranged at the lower ends of the inclined feeders, are attached, the inclined guiding profiles having grooved cuts for passage under the end sections of the first side walls and head walls to be placed facing the lower windows.
- Horizontal push devices which move the head walls and side walls towards the base, which is immobilized against the lower face of the stationary forming die.

Each horizontal push device of the side walls and head walls comprises a pair of opposed linear actuators by means of gripping elements that secure each end and side by their two opposite faces, generating a resulting push movement towards the base.

The lifting device comprises a linear actuator and seating platform supporting the base of the box, the seating platform integrating lugs inserted into first holes of the base and also into second holes of the stationary forming die to ensure a better securing and a precise positioning of the base during the assembly.

The movable head connected to the cylinder arranged above the stationary forming die integrates upper stops and other lower stops that allow compensation for the small deformations in the head walls and side walls.

The cylinder arranged above the stationary forming die is affixed to an upper base affixed to the upper ends of the vertical columns.

The lower edges of the side walls and head walls enter into contact with the base ring when moved downwards by the push skids in correspondence with the lower windows.

The machine also has a base supplying device where the bases are stacked in overlapping horizontal planes, and where the supplying device is arranged in a front area of the machine, before the central assembly station of the boxes.

The machine also integrates a terminal station comprising a box stacker, where the assembled boxes are stacked from below.

The machine also integrates a lower transporter that drags simultaneously, by means of a "pilgrim" movement, a base collected from the managing device and a box formed in the central assembly station having been deposited by means of the descent of the lifting device.

The machine also comprises a rear station located between the central assembly station and the box stacker (terminal station).

The lower transporter integrates pairs of lateral stops between which the different elements supported by said lower transporter are arranged: base and box.

The method for assembling boxes carried out by the machine described above comprises the following steps:

- Dragging a base, by means of the lower transporter, from the base supplying device to an area facing the stationary forming die under the same.
- Moving the base supported by the lower transporter upwards by means of the lifting device until it makes contact with the lower face of the stationary forming die.
- Dragging in a horizontal direction the two opposed head walls arranged in vertical planes until their grooves engage with the respective peripheral flanges of the base.
- Dragging in a horizontal direction the two opposed side walls arranged in vertical planes until their grooves engage with the respective peripheral flanges of the base, and also inserting the notches of the side walls into the end tongues of the head walls.
- Moving the formed box downwards by means of the descent of the lifting device, depositing it in the lower transporter.
- Forward movement of the lower transporter dragging a new base collected from the base supplying device and the box formed in the central assembly box.

It also comprises the following preliminary steps with respect to the steps of the horizontal dragging of the side walls and head walls:

- Moving the first side walls and head walls stacked in the lower section of the inclined feeders downwards until they are placed in correspondence with the lower windows.

Next, in order to facilitate a better comprehension of this specification and being an integral part thereof, figures are attached, in which the object of the invention has been represented in an illustrative rather than limiting manner.

DESCRIPTION OF AN EXAMPLE OF AN EMBODIMENT OF THE INVENTION

Figure 1:
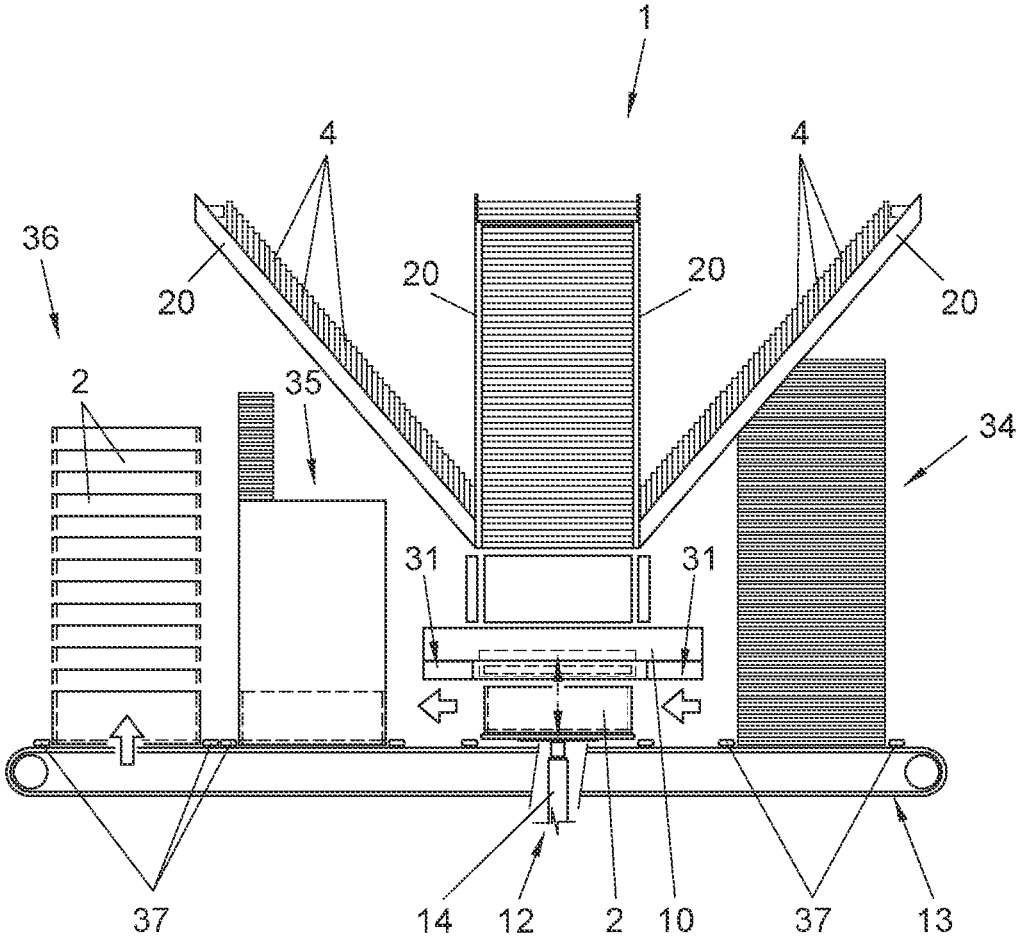
FIG. 1.—Shows an elevated view of the machine for assembling boxes.
Figure 2:
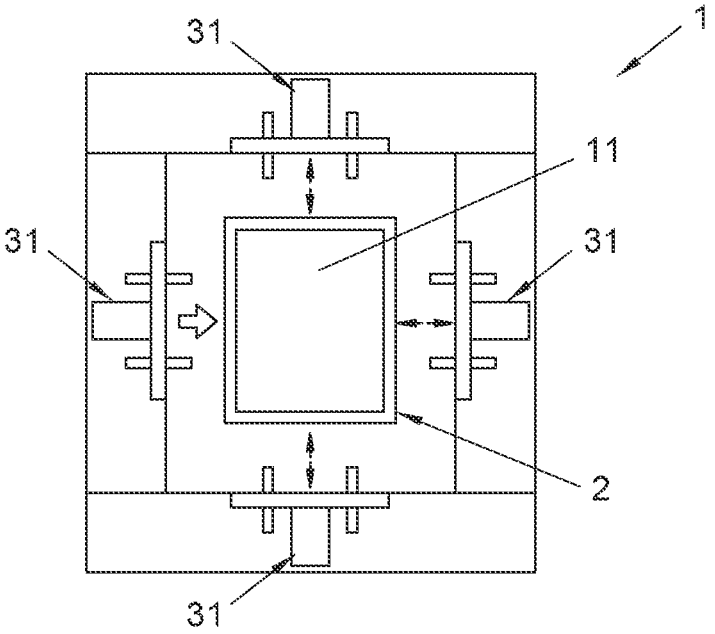
FIG. 2.—Shows a plan view of a central assembly station forming part of the machine of the invention. This assembly station has four inclined feeders converging in a central area, where the assembly of the box materializes.
Figure 3:
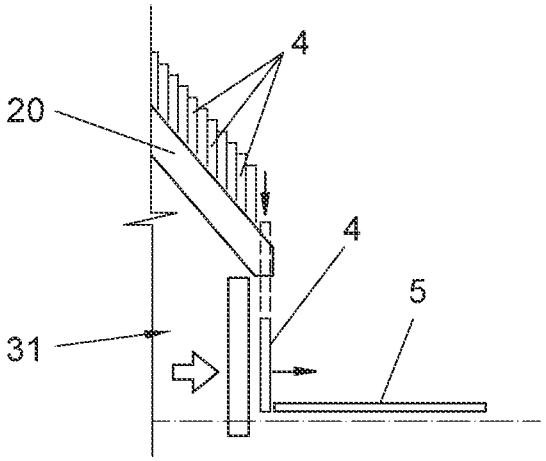
FIG. 3.—Shows an elevated view of one of the inclined feeders of parts corresponding to the lateral walls of the box.
Figure 4:
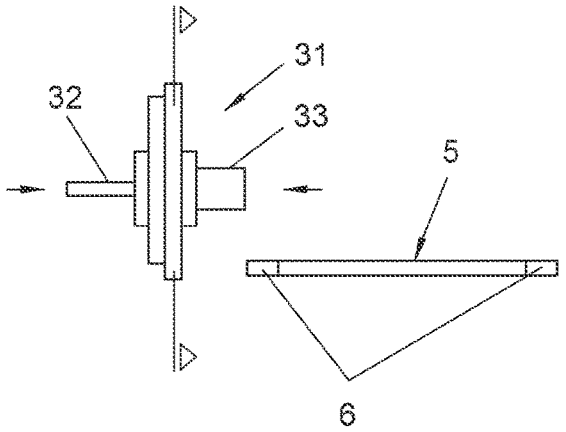
FIG. 4.—Represents a view that essentially shows the elevation process of a base of the box towards an upper position that is held static during the assembly of the box.

The machine comprises a central assembly station 1 of the boxes 2, which integrate four independent parts: two large lateral walls or side walls 3, two small lateral walls, or head walls 4, and a base 5.

The base 5 is provided with peripheral flanges 6 that engage, during the assembly process, with supplementary grooves 7 provided in the lower portion of the side walls 3 and head walls 4. In addition, the head walls 4 are provided with end tongues 8 that are inserted into notches 9 provided close to the ends of the side walls 3.

As is evident, it is possible for the end tongues to be arranged at the side walls 3 and for the notches 9 to be arranged at the head walls 4 as a second option. However, in the example of embodiment, we shall consider the first option described in the preceding paragraph.

Thus, in order to carry out the assembly, the base 5 is located in a static position in a horizontal plane to then move in a horizontal direction, the head walls 4 being arranged in vertical planes until the respective peripheral flanges 6 of the base 5 are engaged with the grooves 7 of the head walls 4.

In a subsequent step, the side walls 3, arranged in vertical planes, are moved in a horizontal direction to also engage the respective peripheral flanges 6 of the base 5 with the grooves 7 of the side walls 3. In this step, it is evident that the end tongues 8 of the head walls 4 are inserted into the notches 9 of the side walls 3.

Thus, the box 2 formed by rigid parts, as referred to in previous sections, is assembled.

The central assembly station 1 comprises a base ring 10, inside which a stationary forming die 11 is arranged, the base 5 of the box 2 to be formed being positioned on its lower face. The placement of the base 5 on the lower face of the stationary forming die 11 is carried out by means of a lifting device 12, which moves the base 5 vertically upwards from a lower transporter 13 located under the central assembly station 1. This lifting device 12 comprises a linear actuator 14 and a seating platform 15 of the base 5, such that the linear actuator 14 drags the seating platform 15 upwards together with the base 5 until the same makes contact with the lower face of the stationary forming die 11, the peripheral flanges 6 protruding with respect to the contour of said stationary forming die 11.

The seating platform 15 has lugs 16, which are inserted into first holes 17 of the base 5 and also into second holes 18 of the stationary forming die 11 to ensure a better securing and a precise positioning of the base 5 during the assembly.

The peripheral flanges 6 protrude outward with respect to the contour of the stationary forming die 11.

It should be noted that, once the box 2 is formed, the lifting device 12 goes downwards to place the assembled box 2 on the lower transporter 13 to drag it forward, as shall be described below.

The central assembly station 1 has also four vertical columns 19 corresponding to the four vertical corners of the box 2, four inclined feeders composed by pairs of inclined guiding profiles 20 converging towards the base ring 10 in turn being affixed to said vertical columns 19, such that the pairs of inclined guiding profiles 20 support the stacks of parts arranged in vertical planes corresponding to the head walls 4 and side walls 3.

The inclined guiding profiles 20 are attached by their converging lower ends to the vertical columns 19 themselves.

On the other hand, the spaces delimited between pairs of vertical columns 19 are covered by vertical plates 21, with the exception of lower windows 22 that allow the passage of the lateral walls of the box 2 during their movement in the assembly step with the base 5.

Outside of said vertical plates 21, the vertical columns 19 have guiding channels 23 of push skids 24 that drag the first flat parts (head walls and side walls) of the stacks downwards until they are located facing the lower windows 22, through which said flat parts are moved to be coupled to each other and with respect to the base. In order to enable the descent operation of the first flat parts of the stacks, the inclined guiding profiles 20 integrate grooved cuts 25 that allow the passage of the end sections of the first flat parts comprising the head walls 4 and side walls 3.

The descent of the first flat parts by means of the push skids 24 ends when the flat parts going down enter into contact, through their lower edge, with the base ring 10, which is when the horizontal push towards the base 5 begins, such that during said movement, the flat parts (side walls and head walls) are guided through their end edges amongst the pairs of vertical columns 19.

The movement of the push skids 24 is carried out by means of a cylinder 26 superiorly housed inside the space delimited by the four vertical columns 19, said cylinder 26 being affixed to an upper base 27 affixed to the upper ends of the vertical columns 19. In turn, the piston rod of the cylinder 26 is connected to a head 28, to which the push skids 24, arranged outside the vertical plates 21, are joined.

Figure 5:
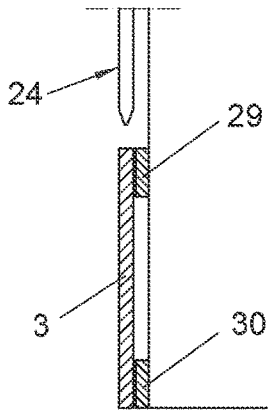
FIG. 5.—Represents a view showing the vertical movement of one of the lateral walls of the box during the assembly process thereof by means of a pair of push skids. Said movement is carried out in the same plane as the lateral wall.
Figure 6:
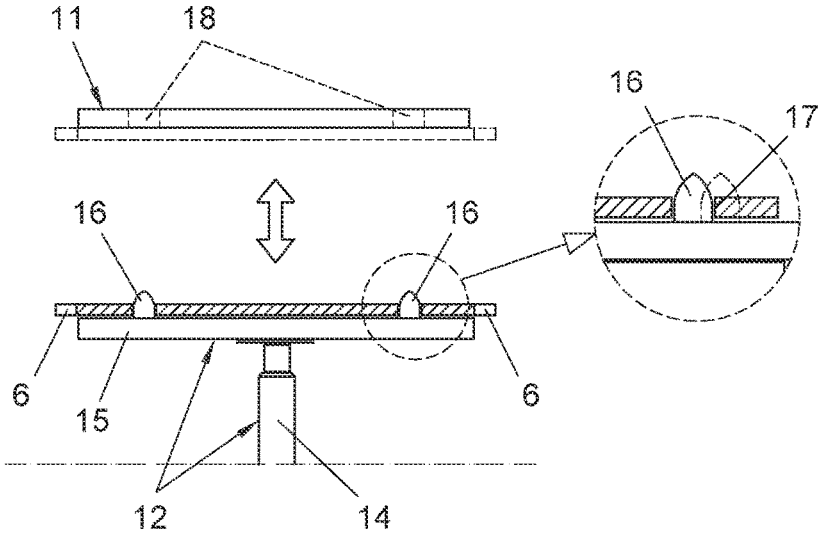
FIG. 6.—Represents a view showing a horizontal movement of one of the lateral walls of the box during the assembly process thereof, said movement being carried out by means of two opposed gripping devices that drag the respective lateral wall until it is engaged with the base.
Figure 7:
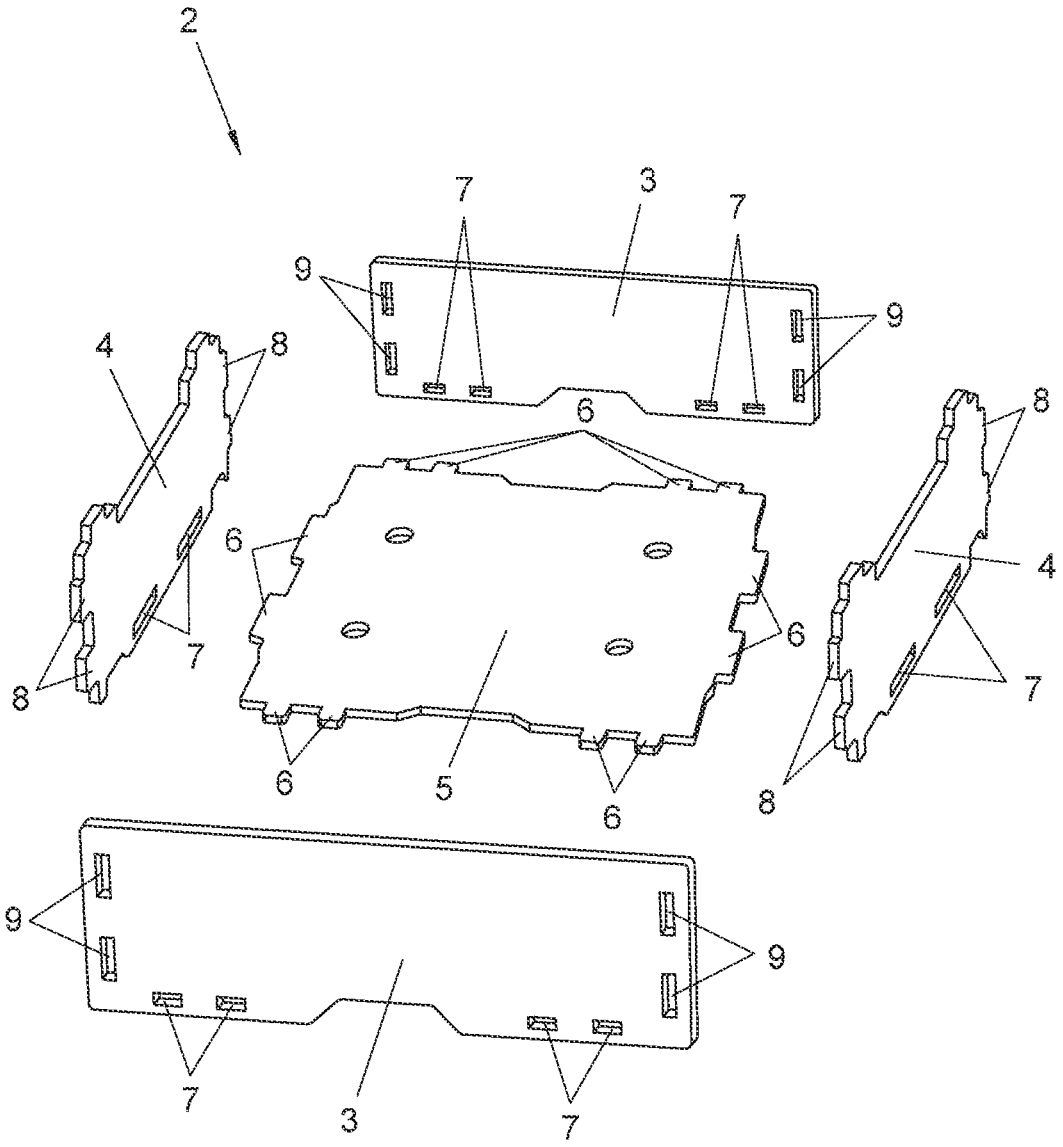
FIG. 7.—Shows an exploded perspective view of a box assembled with the machine of the invention. The box comprises five independent parts: two side walls, two head walls and a base.
Figure 8:
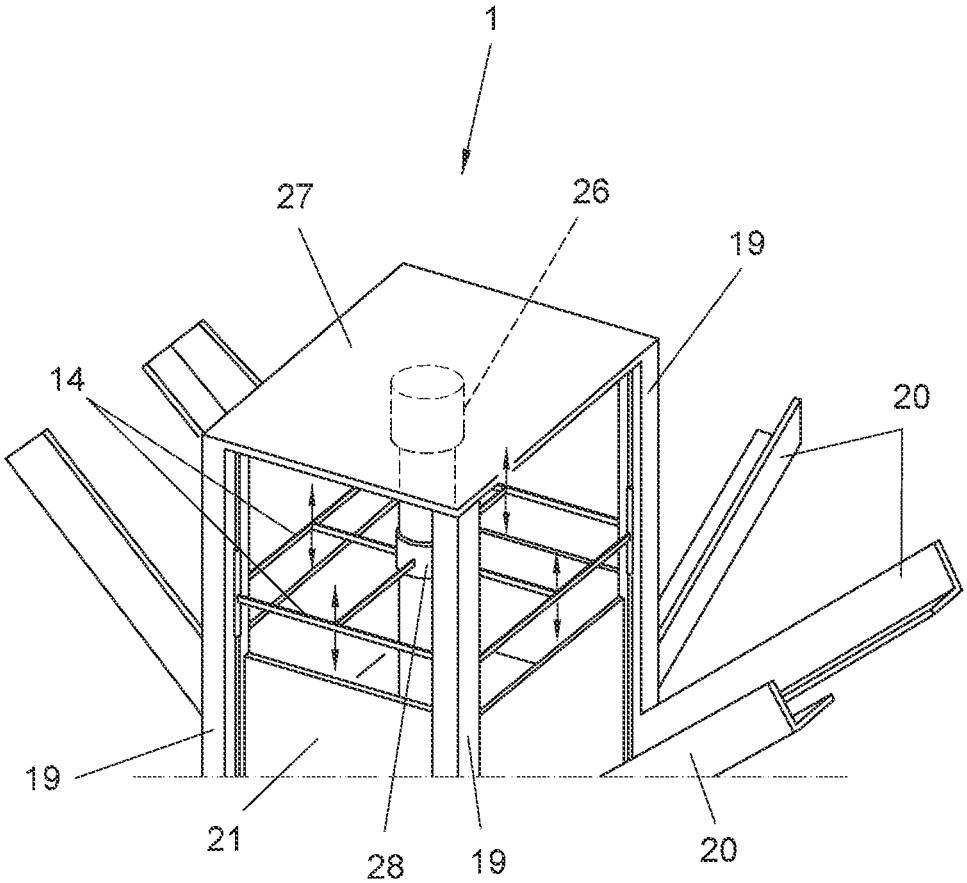
FIG. 8.—Shows a perspective view of the central assembly station.
Figure 9:
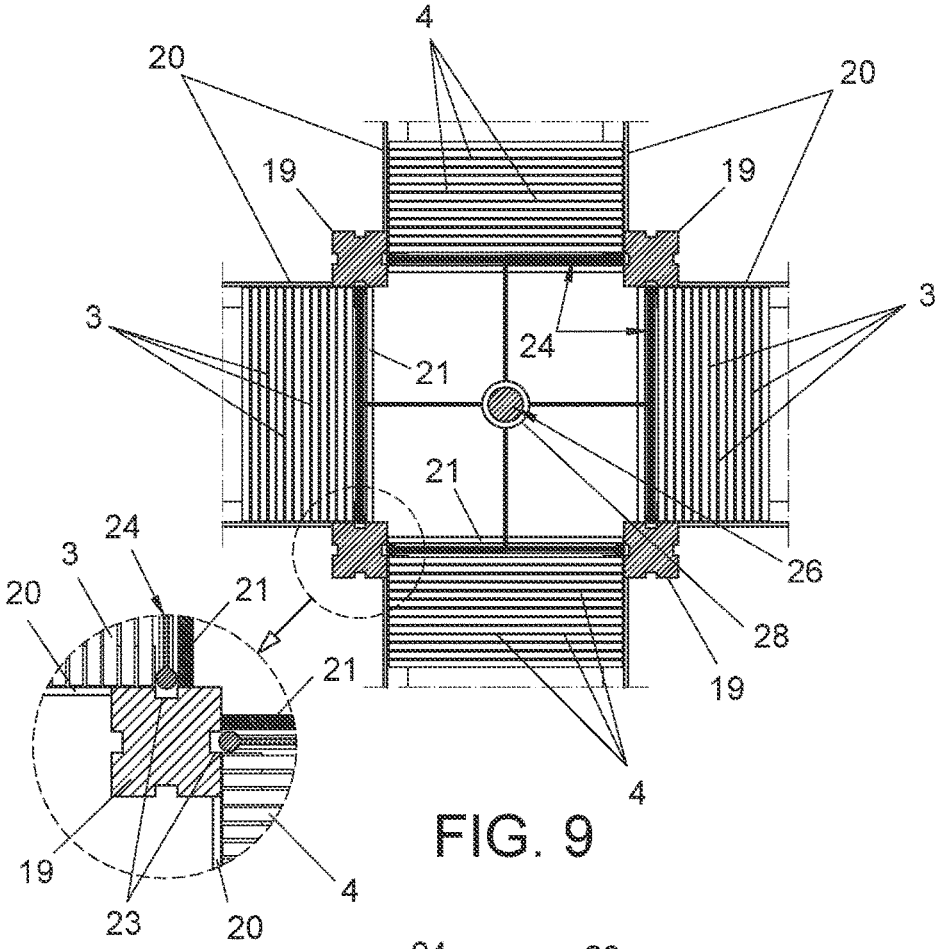
FIG. 9.—Shows a plan view of what is represented in FIG. 8.
Figure 10:
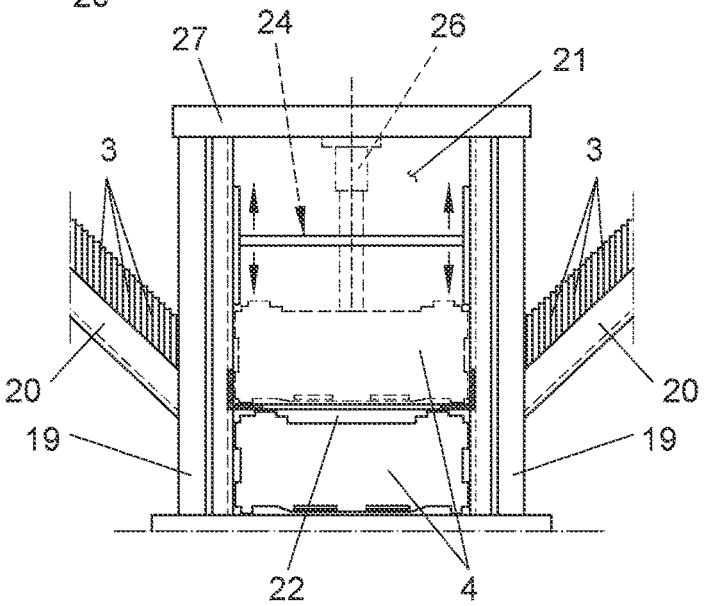
FIG. 10.—Shows an elevated view of the central assembly station.
Figure 11:
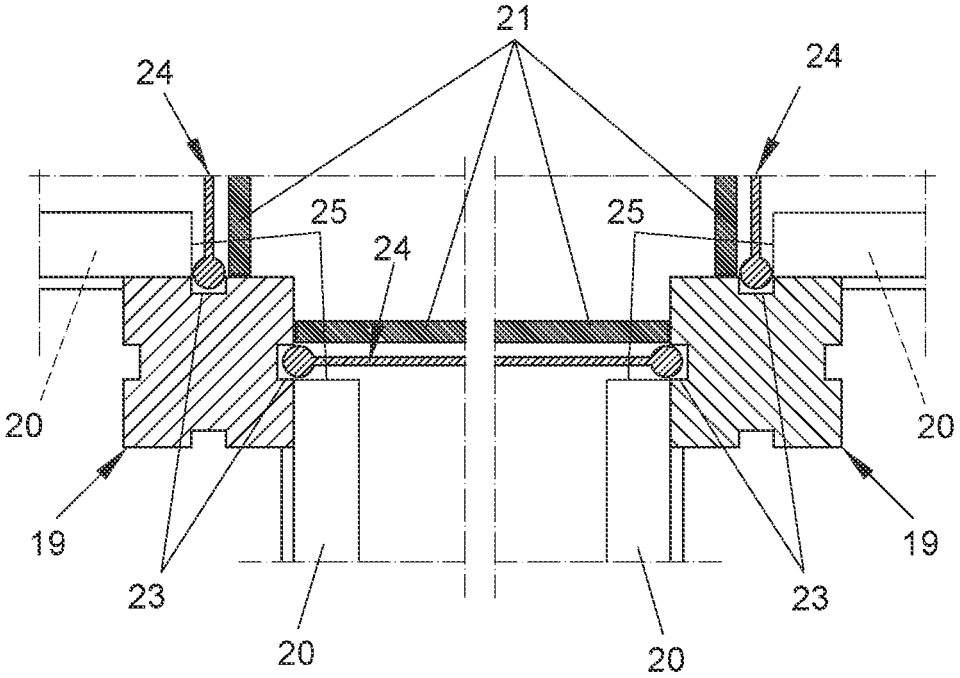
FIG. 11.—Shows a plan view of the central assembly station.

The head 28 also integrates upper stops 29 and lower stops 30 (FIG. 5), which make it possible to compensate for small deformations in the flat parts (head walls and side walls).

The perpendicular drag of the first flat parts (head walls and side walls) towards the base 5, once they face the lower windows 22 and when the head 28 has recovered its upper position, is carried out by means of push devices 31 that act in parallel two by two: first the ones that drag the head walls 4, and then the ones that drag the side walls 3.

These push devices 31 comprise two opposed linear actuators 32, 33 by means of gripping elements that hold each flat part by its two faces, generating a resulting perpendicular push movement towards the base 5 to engage the side walls 3 and head walls 4 with the peripheral flanges 6 of the base 5.

The machine also comprises a base supplying device 34 where the overlapping bases 5 are stacked in horizontal planes, such that under this supplying device 34 there is an initial section of the lower transporter 13 that will drag the last base 5 until it faces the base ring 10 under the same, the lifting device 12 being located in a lower position.

The lower transporter 13 is in charge of carrying out all the movements in a synchronized manner, that is to say, when it performs a movement, it moves all the elements that it supports: the base 5, which is dragged from the supplying device 34 to the central assembly station, a box 2 assembled in the central assembly station 1, which is dragged to a rear station 35 arranged after the central assembly station 1, and another box 2 dragged to a terminal station 36 determined by a box stacker.

Each element supported by the lower transporter 13 is separated from contiguous elements by means of pairs of lateral stops 37 integrated in said lower transporter 13.

Taking into account the numbering adopted in the figures, the machine for assembling boxes contemplates the following nomenclature used in the description:

1.—Central assembly station.
2.—Boxes.
3.—Side walls.
4.—Head walls.
5.—Bases.
6.—Peripheral flanges.
7.—Grooves.
8.—End tongues.
9.—Notches.
10.—Base ring.
11.—Stationary forming die.
12.—Lifting device.
13.—Lower transporter.
14.—Linear actuator.
15.—Seating platform.
16.—Lugs.
17.—First holes.
18.—Second holes.
19.—Vertical columns.
20.—Inclined guiding profiles.
21.—Vertical plates.
22.—Lower windows.
23.—Guiding channels.
24.—Push skids.
25.—Grooved cuts.
26.—Cylinder.
27.—Upper base.
28.—Head.
29.—Upper stops.
30.—Lower stops.
31.—Push device.
32.—Opposed linear actuator.
33.—Opposed linear actuator.
34.—Supplying device.
35.—Rear station.
36.—Terminal station.
37.—Pairs of lateral stops.

The invention claimed is:

1. A machine for assembling boxes, the boxes each comprising five independent parts made of a rigid material: two side walls, two head walls and a base with peripheral flanges that engage with grooves in a lower portion of the side walls and the head walls, the head walls having end tongues that are inserted into notches adjacent to ends of the side walls; the machine integrating a central assembly station which comprises:

four feeders of the side walls and the head walls facing each other two by two;

moving means that move the side walls and the head walls from the feeders to lateral edges of the base in a final step of assembly of one of the boxes, wherein the central assembly station further comprises:

a base ring inside which a stationary forming die is arranged where, on a lower face of the stationary forming die, the base to be formed is placed by a lifting device with vertical mobility in both directions, which moves the base upwards from a lower position to an upper position against the stationary forming die in a first performance, the peripheral flanges protruding from the base with respect to a perimeter of the stationary forming die.

2. The machine for assembling boxes according to claim 1, wherein the four feeders comprise an inclined structure wherein the side walls and the head walls are arranged in overlapping vertical planes, each of the four feeders comprising pairs of inclined guiding profiles attached by converging lower ends thereof to vertical columns corresponding to four vertical corners of the one of the boxes.

3. The machine for assembling boxes according to claim 2, wherein the central assembly station comprises push skids that move the side walls and the head walls arranged at lower ends of the four feeders downwards, the inclined guiding profiles having grooved cuts for passage under end sections of the side walls and the head walls to be placed facing the lower windows.

4. The machine for assembling boxes according to claim 3, wherein the push skids are connected to a head which is vertically movable in both directions, the head being connected to a piston rod of a cylinder located inside a space delimited by the vertical columns above the stationary forming die.

5. The machine for assembling boxes according to claim 4, wherein the head integrates upper stops and lower stops to compensate for small deformations in the side walls and the head walls.

6. The machine for assembling boxes according to claim 4, wherein the cylinder arranged above the stationary forming die is affixed to an upper base affixed to upper ends of the vertical columns.

7. The machine for assembling boxes according to claim 3, wherein lower edges of the side walls and the head walls enter into contact with the base ring when moved downwards by the push skids.

8. The machine for assembling boxes according to claim 1, wherein the moving means of the side walls and the head walls comprise horizontal push devices which move the side walls and the head walls against the base which is immobilized against the lower face of the stationary forming die.

9. The machine for assembling boxes according to claim 8, wherein each of the horizontal push devices of the side walls and the head walls comprises a pair of opposed linear actuators by gripping elements that hold each of the head walls and the side walls by two opposite faces thereof, generating a resulting forward movement of a first of the opposed linear actuators with respect to a second of the opposed linear actuators.

10. The machine for assembling boxes according to claim 1, wherein the central assembly station comprises vertical plates closing spaces delimited between pairs of vertical columns, except for lower windows through which the side walls and the head walls pass during horizontal movement thereof to engage with the peripheral flanges of the base at and end of the assembly of the one of the boxes, where the side walls and the head walls enter into contact with peripheral edges of the stationary forming die.

11. The machine for assembling boxes according to claim 1, wherein:

the lifting device comprises a linear actuator and a seating platform supporting the base;

the seating platform integrates lugs that are inserted into first holes of the base and also into second holes of the stationary forming die to ensure a better securing and a precise positioning of the base during assembly thereof.

12. The machine for assembling boxes according to claim 1, further comprising:

a supplying device of bases stacked in overlapping horizontal planes, where the supplying device is arranged in a front area of the machine, before the central assembly station of the boxes;

a terminal station that comprises a box stacker where the boxes that have been assembled are stacked from below;

a lower transporter that drags simultaneously, by a "pilgrim" movement, one of the bases collected from the supplying device and one of the boxes formed in the central assembly station which as been deposited by descent of the lifting device.

13. The machine for assembling boxes according to claim 12, further comprising a rear station located between the central assembly station and the box stacker.

14. The machine for assembling boxes according to claim 12, wherein the lower transporter integrates pairs of lateral stops between which one of the bases and one of the boxes supported by the lower transporter are arranged.

* * * * *